US005303679A

United States Patent [19]

Gamon

[11] Patent Number: 5,303,679

[45] Date of Patent: Apr. 19, 1994

[54] ROTARY INTERNAL COMBUSTION ENGINE

[76] Inventor: Vicente Gamon, 25 - 1°0, Irun, S.S., Spain

[21] Appl. No.: 105,117

[22] Filed: Aug. 12, 1993

[51] Int. Cl.[5] ..... F02B 57/00

[52] U.S. Cl. ..... 123/44 C

[58] Field of Search ..... 123/43 R, 43 C, 44 R, 123/44 C, 55 R

[56] References Cited

U.S. PATENT DOCUMENTS

| | | | |
|---|---|---|---|
| 3,822,681 | 7/1974 | Townsend | 123/43 C |
| 3,885,533 | 5/1975 | Townsend | 123/43 C |
| 3,921,601 | 11/1975 | Maoz | 123/43 C |
| 4,177,771 | 12/1979 | Nutku | 123/44 C |
| 4,249,487 | 2/1981 | Chambers | 123/44 C |
| 4,300,487 | 11/1981 | Triulzi | 123/44 C |
| 4,612,882 | 9/1986 | Bonfilio | 123/44 C |

*Primary Examiner*—Tony M. Argenbright

*Assistant Examiner*—M. Macy

*Attorney, Agent, or Firm*—Pierre Lespérance; Francois Martineau

[57] ABSTRACT

This engine includes an engine block rotatably mounted on a support and including a central chamber communicating with outwardly protruding radial piston chambers closed by cylinder heads. A crank shaft is rotatably mounted in the engine block parallel to the rotation axis of the latter and radially offset therefrom. A drive train couples the engine block with the crank shaft for causing rotation of the two in the same direction and at equal rotational speed. A piston is reciprocable in each piston chamber and all the pistons are linked by connecting rods to the crank shaft at connecting points which are angularly advanced in the direction of rotation of the engine block relative to the longitudinal axes of the piston chambers. It follows that the combustion stroke is effected while the connecting rods exert a maximal torque on the crank shaft.

17 Claims, 9 Drawing Sheets 12
104
106
2
102
6
14
132
104

96
14
100
98
102
106
116
128
104
128
3
11
118
10

124
122
120
104
124
122
120
104

120
104
116
124
116
122
8
8
9
9
11

104
106
120
122
122
10
120
128

ROTARY INTERNAL COMBUSTION ENGINE

FIELD OF THE INVENTION

The present invention relates to a rotary internal combustion engine.

BACKGROUND OF THE INVENTION

U.S. Pat. No. 4,421,073 dated Dec. 20, 1983 and titled INTERNAL COMBUSTION ROTARY ENGINE by ARREGUI et al, the present applicant being one of the four co-inventors, describes an engine block which is rotatably mounted within a stationary casing which closes the open outer ends of the piston chambers. It has been found in practice that it is very difficult to seal the piston chambers at their interface with the casing.

U.S. Pat. No. 4,645,428 by the same four co-inventors and dated Feb. 24, 1987 for RADIAL PISTON PUMP, describes a device which is not suitable for use as an internal combustion engine even if the basic operating principle is similar to that of the engine in accordance with the present invention.

OBJECTS OF THE INVENTION

The present invention aims to provide a rotary internal combustion engine which is based on a similar operating principle as that of the RADIAL PUMP of U.S. Pat. No. 4,645,428.

Another object of the present invention is to provide an engine more particularly suited to operate as a two-cycle engine.

Another object of the present invention is to provide an engine of the character described which has a very low idle speed compared to conventional piston-type internal combustion engines.

Another object of the present invention is to provide an engine of the character described in which the torque exerted by the connecting rods on the crank shaft is at a maximum during the entire combustion stroke.

Another object of the present invention is to take advantage of the centrifugal force exerted on the admission gases and exhaust gases to improve engine breathing.

Another object of the present invention is to provide an intake valve within each piston, and to admit the combustible gas admitted within the central engine block chamber.

Another object of the present invention is to provide an engine of the character described which takes advantage of the engine block rotation for air-cooling the engine.

Another object of the present invention is to provide an engine of the character described in which the rotating engine block eliminates the requirement for a separate fly-wheel.

Another object of the invention is to provide an engine of the character described which can be coupled to a similar engine with their operating cycles being out of phase.

Another object of the invention is to provide an engine of the character described in which ignition is effected continuously during a few degrees of the expansion of the combustion stroke for better engine starting results.

Another object of the present invention is to provide an engine of the character described which does not require a mechanism for spark advance or retardation.

Another object of the present invention is to provide an engine of the character described in which the exhaust gases are discharged in a direction normal to the piston chamber axis and away from the direction of engine block rotation so as to assist this rotation.

Another object of the present invention is to provide an engine of the character described which is very easy to start and which can be equipped with a supercharger system to increase its horsepower rating.

SUMMARY OF THE INVENTION

The rotary internal combustion engine of the invention comprises a support, an engine block rotatably mounted on the support and defining a central chamber and at least one piston chamber radially protruding from said central chamber and communicating with the latter at its radially inner end, a piston chamber head closing the radially outer ends of the piston chamber, a crank shaft rotatably mounted in the engine block parallel to and radially offset from the engine block rotation axis, a drive train coupling the engine block and crank shaft for producing rotation of both the engine block and crank shaft at equal speed and in the same direction, the crank shaft extending within the central chamber, a piston reciprocable in the piston chamber, a connecting rod pivotally connected to the piston and to a connecting point of the crank shaft which is radially spaced from the axis of said crank shaft and angularly advanced in the direction of rotation of the engine block relative to the longitudinal axis of the piston chamber.

The crank shaft may be the power output shaft or such an output shaft may be directly fixed to the engine block on one side of the central chamber and co-axial with the engine block rotation axis being journaled in the support.

Normally, the engine has several piston chambers, equally angularly spaced in a common plane with the connecting rods of their respective pistons connected to the same crank shaft.

The engine is preferably provided with combustible gas intake means which communicate directly with the central chamber and with passage means between the central chamber and the explosion chambers. Preferably the passage means include orifices through the pistons which are fitted with check valves to permit passage of combustible gases only from the central chamber to the explosion chambers. Preferably there are provided second passage means extending through the engine block externally of the piston chambers and communicating the central chamber with the explosion chambers. The piston orifices together with said last named passages improving the breathing capacity of the engine.

The engine ignition means include an ignition plug provided with a collector and a high voltage current fed emitter fixed to the support and extending in the path of the collector to provide a continuous electrical connection between the emitter and collector for at least a few degrees of the combustion stroke in order to further increase the starting efficiency engine.

Preferably the engine is air-cooled. The piston chambers being provided with external fins for heat transfer to the air from the rotating engine block.

Preferably the exhaust gas valves are carried by the cylinder heads and are provided with exhaust gas discharge nozzles fixed to each cylinder head, disposed substantially normal to the long axis of the piston chambers and extending away from the direction of rotation of the engine block so as to produce a exhaust gas jet which assists engine block rotation.

DETAILED DESCRIPTION OF THE ANNEXED DRAWINGS

Figure 3:
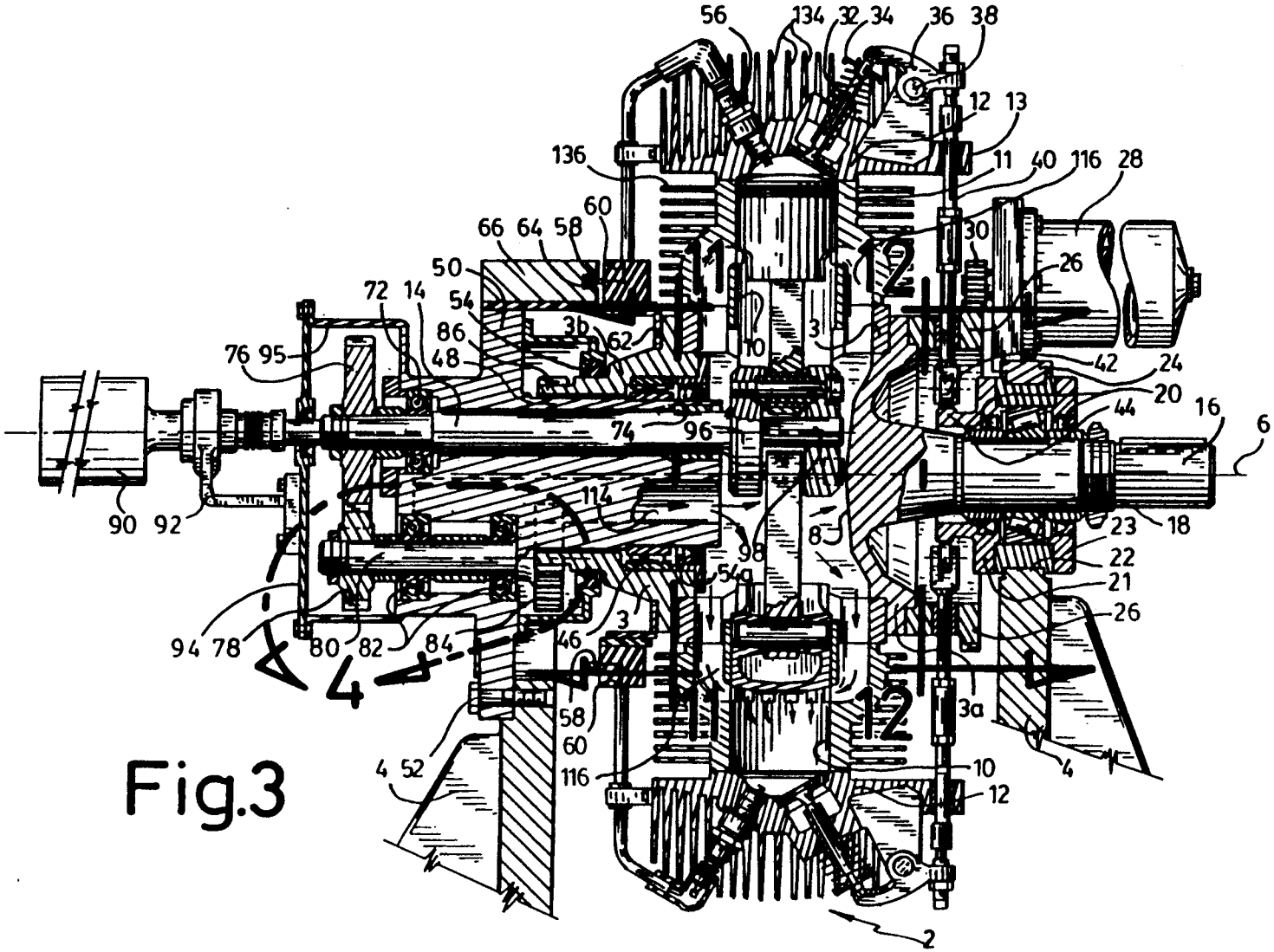
FIG. 3 is a longitudinal section taken along line 3—3 of FIG. 2.
Figures 7, 8, 9, 10, 10A:
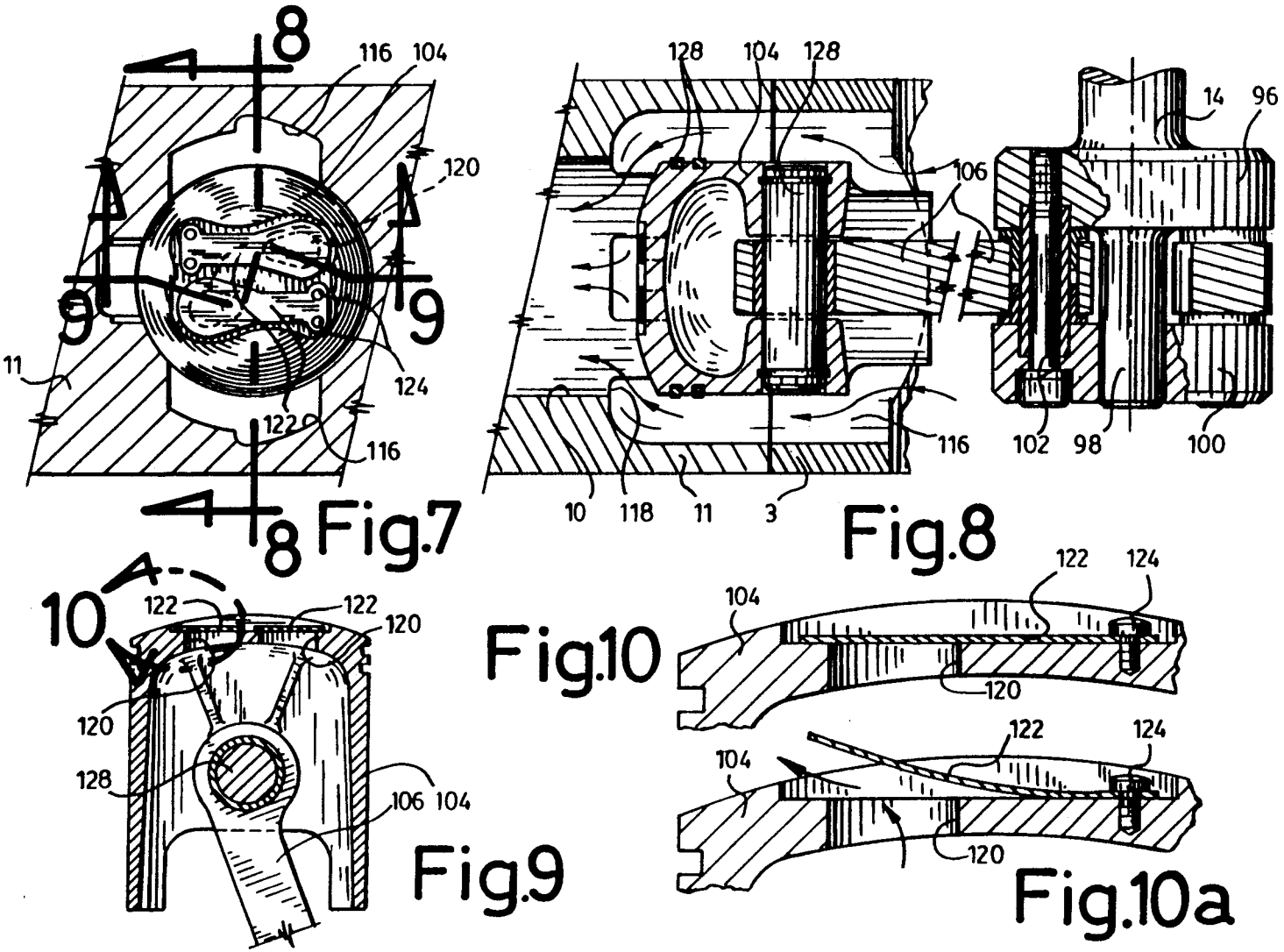
Figure 12:
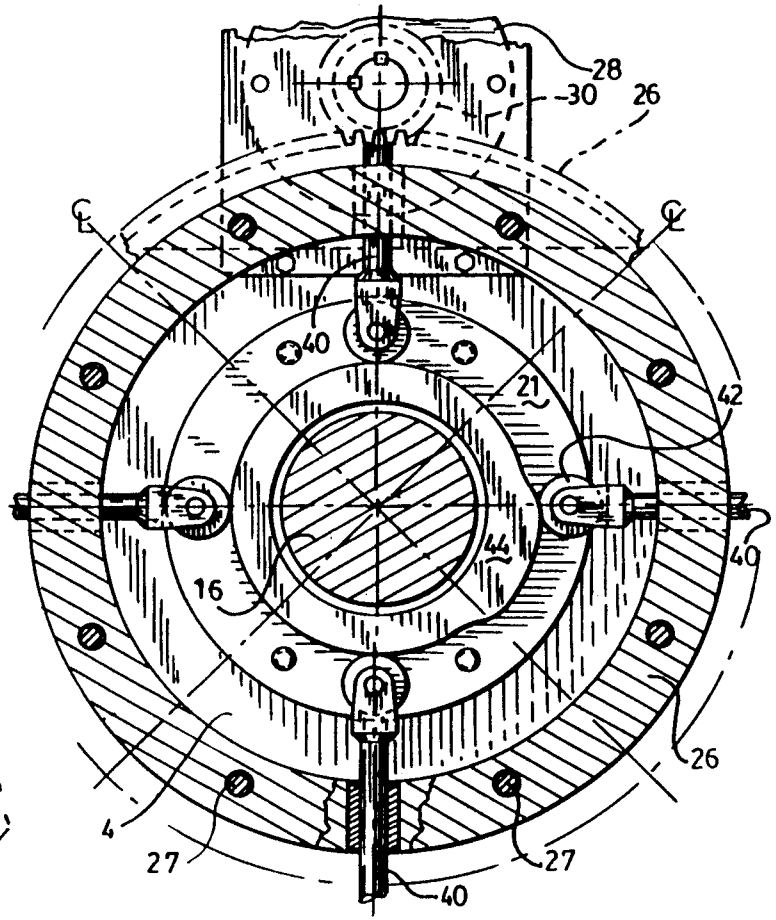
Figure 11:
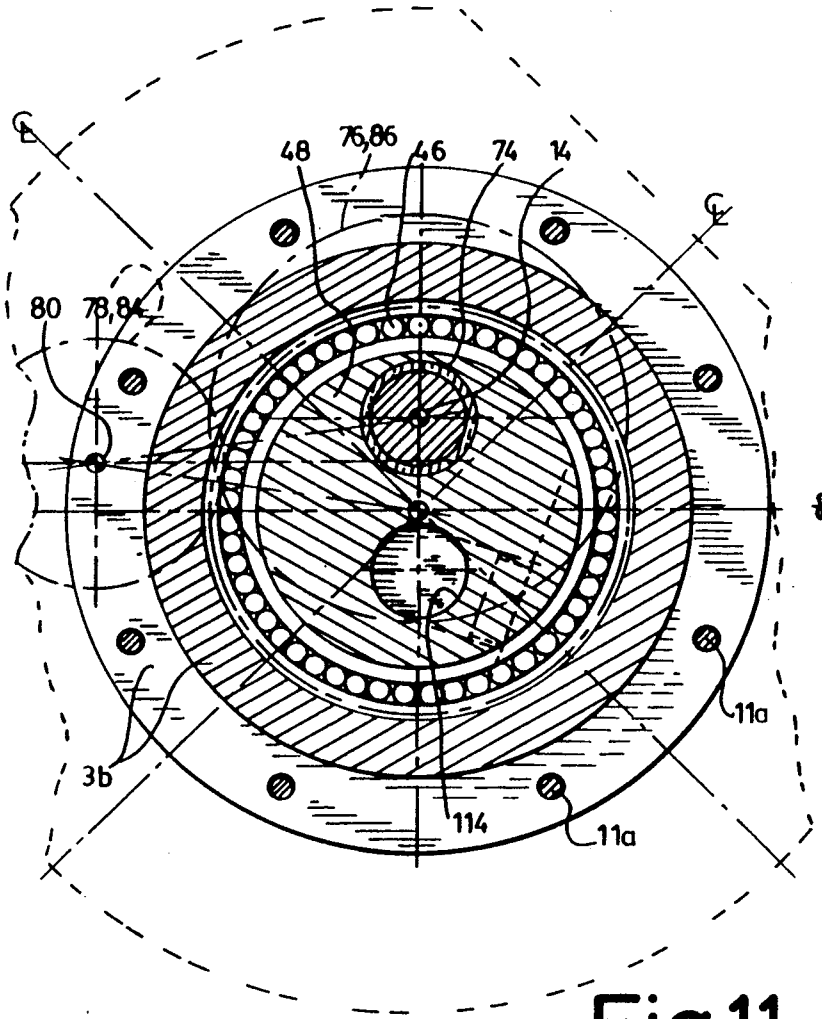
Figure 13:
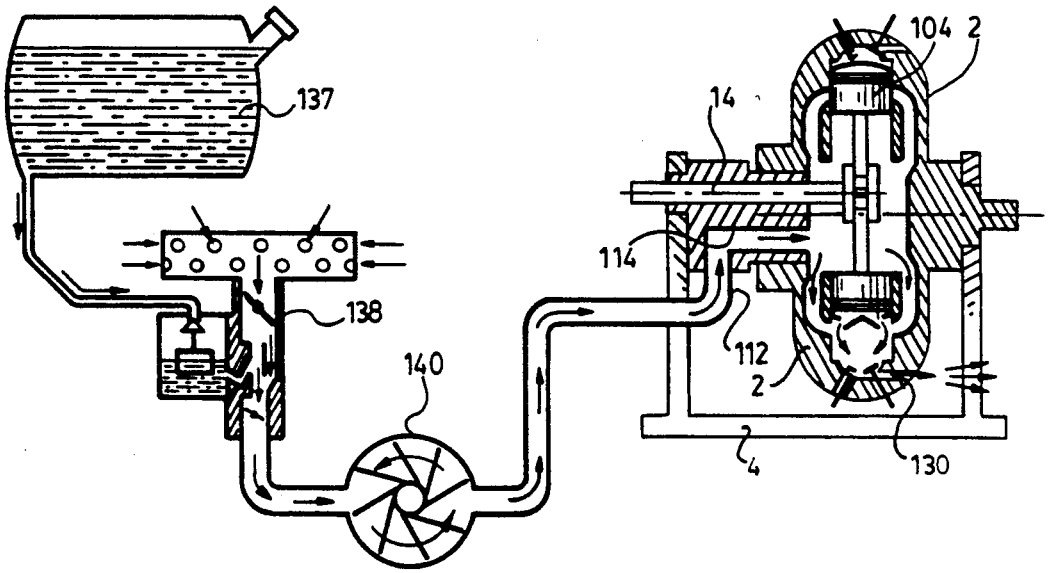
Figure 14:
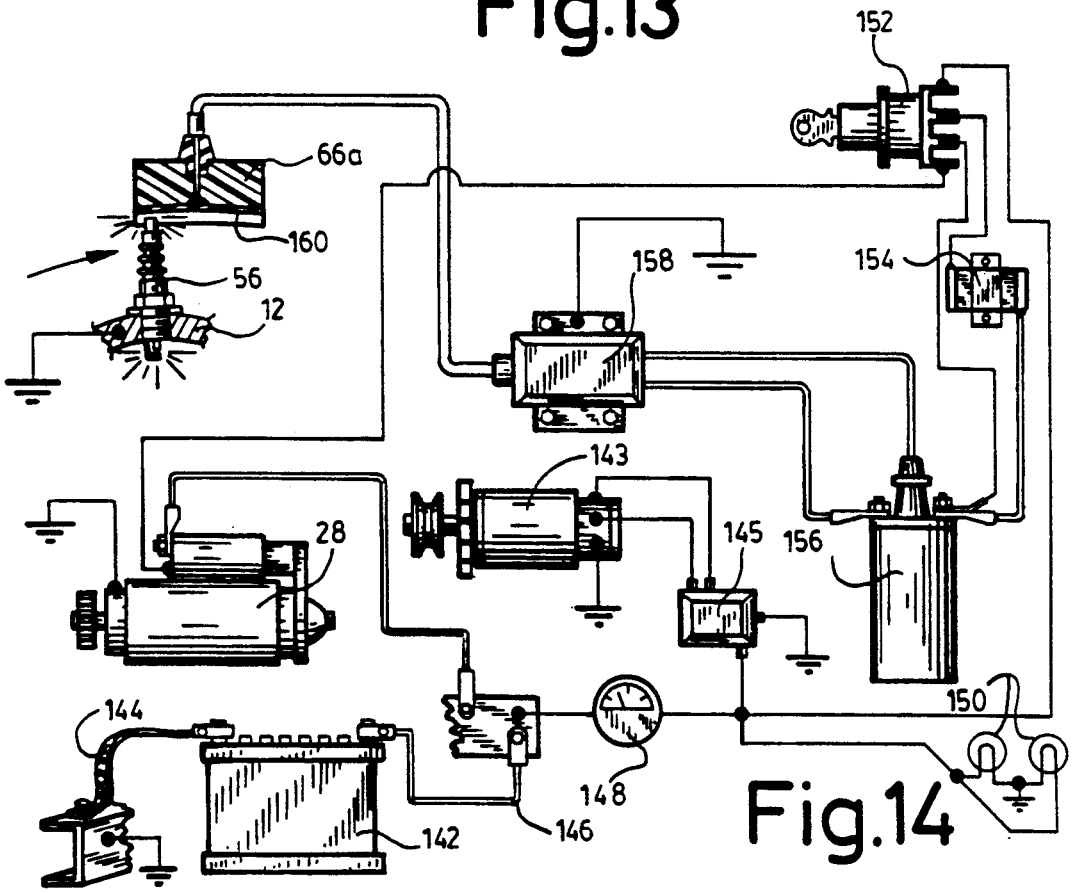
Figure 15:
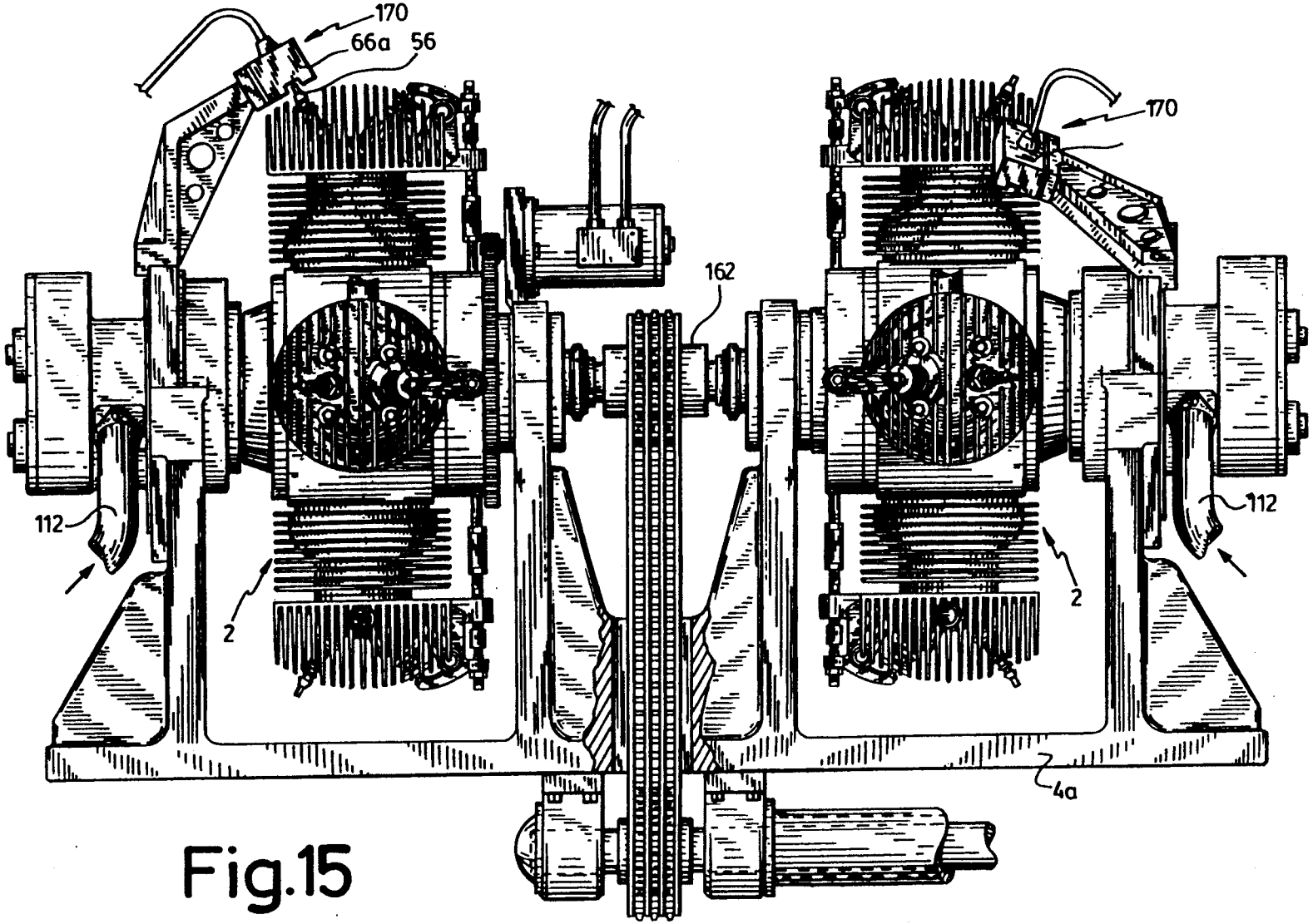

FIGS. 6 and 6A to 6E inclusive show one cylinder of the engine block during a nearly complete rotation of said engine block and showing the associated piston at various stages of its two-stroke operating cycle;

FIG. 7 is a plan section of one cylinder chamber showing one piston in top end view and a check valve mounted thereon;

FIG. 8 is a cross-section taken along line 8—8 of FIG. 7;

FIG. 9 is another section taken along line 9—9 of FIG. 7;

FIGS. 10 and 10A show the check valve taken in area 10 of FIG. 9 in closed and opened position respectively;

FIGS. 11 and 12 are sections taken along line 11—11 and 12—12 respectively of FIG. 3;

FIG. 13 is a schematic diagram of the engine and of its combustible gas supply system;

FIG. 14 is a schematic diagram of the electrical ignition circuit and engine starter means; and FIG. 15 is partial front elevation of two similar engines of the invention coupled to drive a common output shaft.

In the drawing like reference characters indicate like elements throughout.

DETAILED DESCRIPTION OF THE PREFERRED EMBODIMENTS

Figure 1:
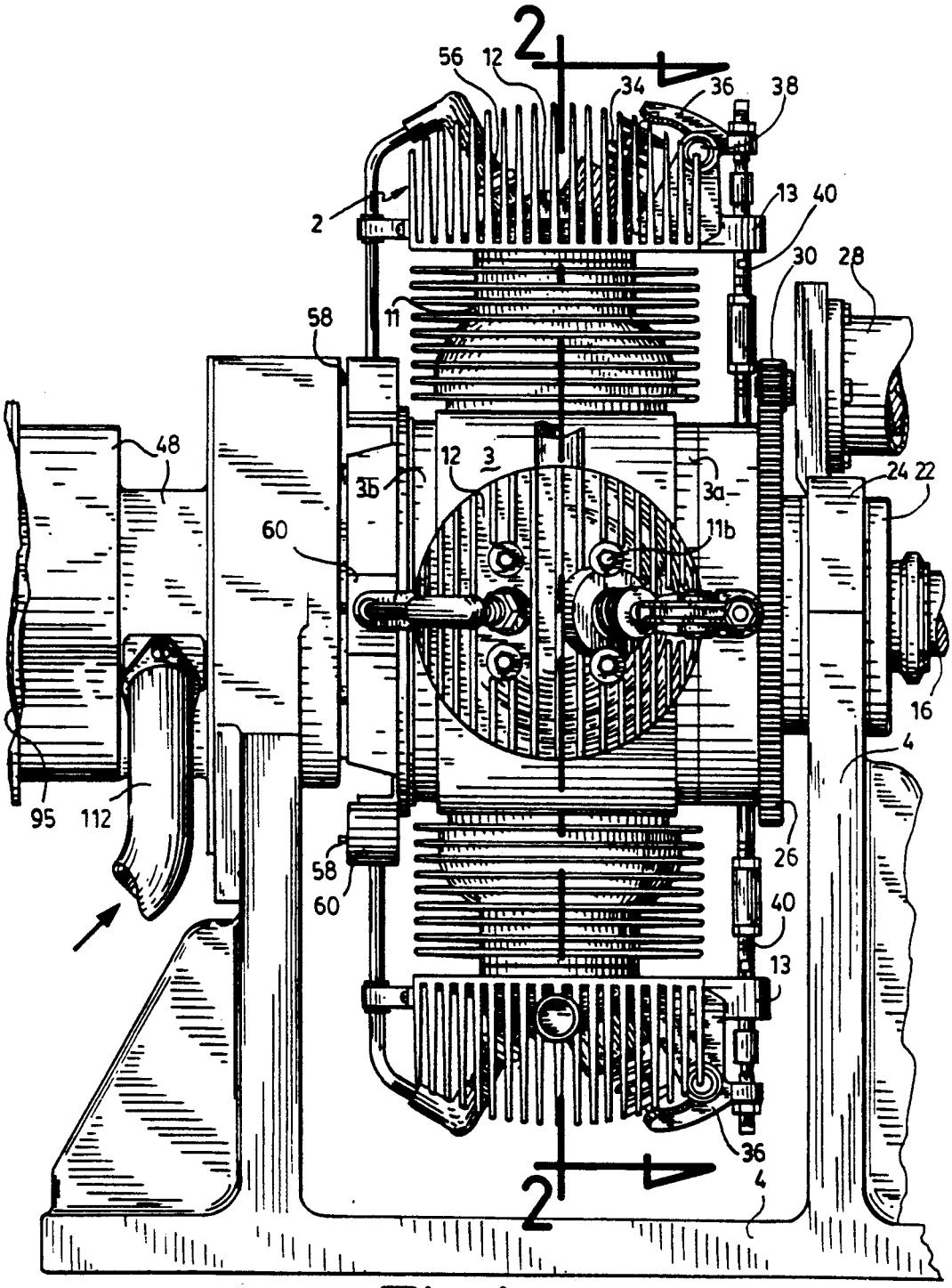
FIG. 1 is a partial side elevation of the engine of the invention.
Figure 2:
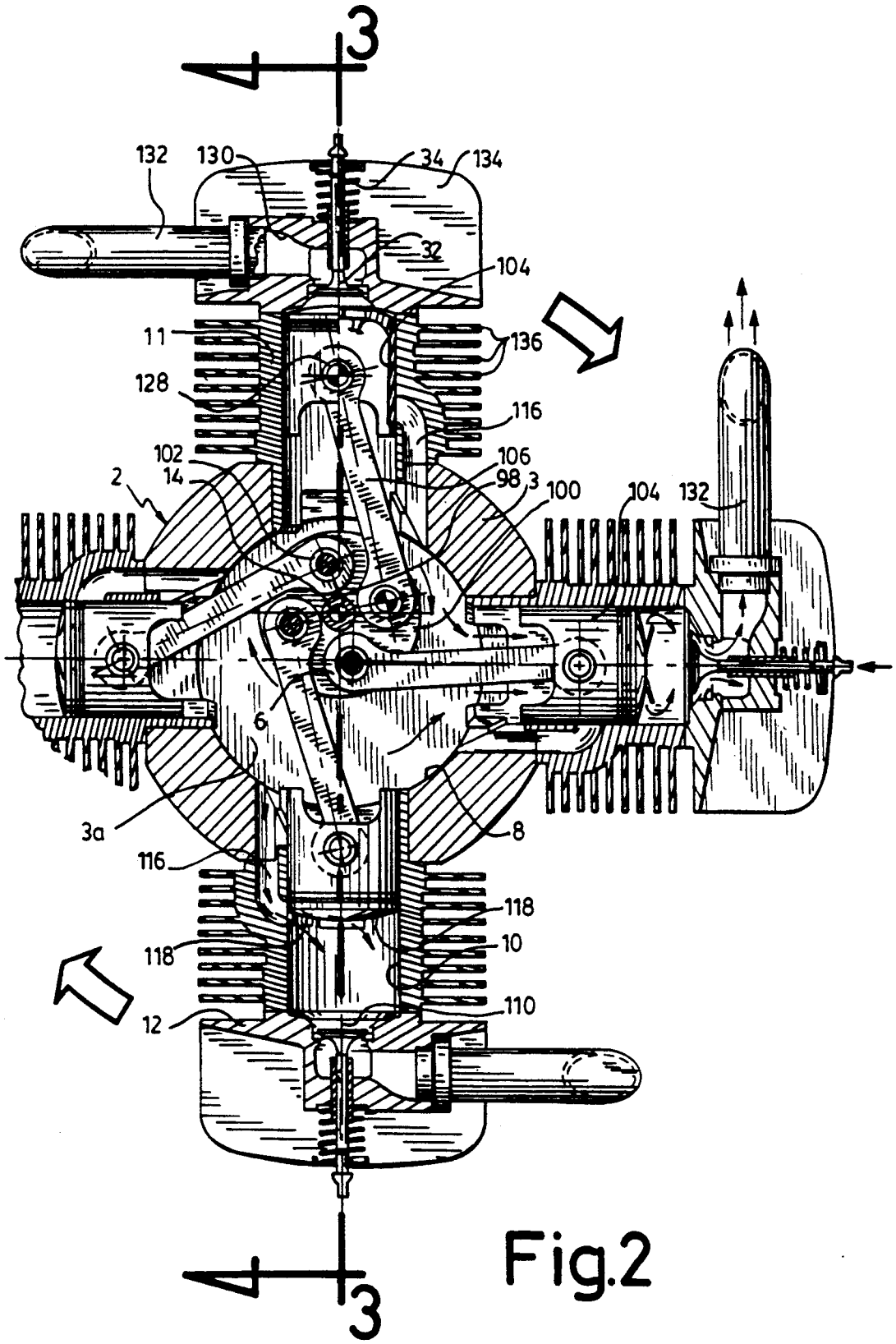
FIG. 2 is a partial cross-section taken along line 2—2 of FIG. 1.

Referring to FIGS. 1, 2 and 3 an engine block 2 is mounted for rotation on a support 4 about the engine block rotation axis 6; engine block 2 defines a central chamber 8 formed by a core 3 and several, for instance 4, radially arranged piston chambers 10 formed by cylinders and communicating at their radially inner end with the central chamber 8 and closed at their radially outer end by a cylinder head 12. The cylindrical core 3 of engine block 2 is closed by core covers 3*a* and 3*b*. Bolts 11*b* secure cylinder head 12 and cylinder 11 to core 3. Cover cover 3*a* is secured to core 3 by bolts 27 (see FIG. 12). Core cover 3*b* is secured to core 3 by bolts 11*a* (see FIG. 11). A power output shaft 16 is integrally formed with core cover 3*a* of engine block 2, extends on one side of central chamber 8 and is co-axial with engine block rotation axis 6. The output shaft 16 is journaled by a thrust bearing 18 in a ring assembly 21, 22 and 23 fixed on support 4 by a strap 24. Seals 20 seal the lubricating oil for bearing 18. An annular gear 26 is fixed to core cover 3*a* of engine block 2 on the same side as output shaft 16 and spacedly surrounds part of said output shaft and is co-axial therewith.

A starter motor 28 is fixed to support 4 and its sprocket 30 meshes with gear 26. Starter motor 28 is provided with a suitable Bendix system and serves to start the engine by rotating the engine block. In the example shown, there are four piston chambers 10 which are 90 degrees apart, all in the same plane and truly radial with the rotation axis 6.

Each cylinder head 12 carries an exhaust valve 32 of conventional construction and spring-actuated to closed the position. Each exhaust valve 32 is opened against the action of its spring 34 by a rocker arm 36 pivoted at 38 on the cylinder head 12 and actuated by an adjustable length pusher rod 40 extending through the hub of annular gear 26 being guided thereby and also by cylinder head ear 13. Pusher rod 40 carries a cam-follower roller 42 riding on a cam 44 formed by part 21 of the ring assembly 21, 22 and 23 (see also FIG. 12). This Figure also shows that annular gear 26 is fixed to engine block core 3 by bolts 27.

At its side opposite power output shaft 16, the engine block 2 is journaled by means of needle bearings 46 around the outside of a cylindrical support part 48 which is provided with a outwardly directed annular flange 50 and fixed by bolts 52 to the support 4.

Seals 54 and 54*a* are provided on each side of the needle bearing 46.

The ignition means include a spark plug 56 carried by each cylinder head 12 and electrically connected to a collector 58 in the form of a pin. Each of the four collector pins 58 are carried by a ring 60 made of electrically insulating material and supported by a bracket 62 co-axially with the rotation axis 6 and spacedly surrounding the engine block core 3. The four collector pins 58 ride within a groove 64 of a conductor ring section 66 supported on the flange 50 of the support part 48 through insulating gasket 68. Conducting ring section 66 extends through a few degrees of engine rotation. The arrangement is such that the spark plug 56 can be fired continuously through a few degrees of rotation of the engine block.

The cam shaft 14 is rotatably mounted in a through bore of support part 48 being journaled in said support part by ball bearing 72 and pre-lubricated bushing 74, the latter disposed near the central chamber 8.

A drive train is provided to rotate cam shaft 14 in the same direction and at the same rotational speed as that of the engine block 2. This drive train includes a main gear 76 fixed to the outer end of crank shaft 14 and meshing with a sprocket 78 which is fixed to an auxiliary shaft 80 journaled by bearings 82 in support part 48 and carrying a second sprocket gear 84 of the same diameter as gear 78 and which meshes with an annular gear 86 carried by the core 3 of the engine block 2 and of the same diameter as that of main gear 76.

If desired, a revolution counter 90 is connected to the outer end of crank shaft 14 and is supported by a bracket 92 fixed to a cover 94 which is removably secured to the support part 48 to close a cavity 95 made therein for housing the main gear 76 and sprocket gear 78. Lubricating oil for these gears is contained in cavity 95 and also in the cavity housing gears 84, 86 and sealed by seal 54.

The inner end of crank shaft 14 is formed with a wheel 96 located within the central chamber 8 and the shaft is extended by stud 98 on which is fixed a disk 100 of the same diameter as wheel 96 and spacedly secured thereto by means of wrist bolts 102.

A piston 104 is reciprocally mounted within each piston chamber 10 and is pivotally connected by a connecting rod 106 to the crank assembly of the wheel 96 and disk 100 by means of the wrist bolt 102. The four wrist bolts form the connecting points of the connecting rods 106 to the crank shaft 14 which are equally radially spaced from the axis of shaft 14 and which are angularly advanced in the direction of rotation of the engine block as represented by arrows 108 in FIG. 2 with respect to the longitudinal axis 110 of the piston chamber 10. As clearly shown in FIG. 2, the straight line interconnecting each connection point to the axis of crank shaft 14 is nearly perpendicular to long axis 110 of the respective piston chambers 10. This relationship remains more or less constant during a complete revolution of the engine block so that upon firing of any cylinder, a maximum torque will be exerted on the cam shaft during substantially the entire combustion stroke.

As shown in FIGS. 1 and 3, the combustible gas intake includes a lateral tube 112 which protrudes from the support part 48 and which communicates with a longitudinal bore 114 made in support part 48 and which opens within the central chamber 8. This chamber communicates in turn with the four piston chambers 10 through two sets of passageways, namely a first set of radial passage ways 116 formed exteriorly of and around each piston chamber 10, in communication at the inner end with the central chamber 8 and opening at ports 118 in the cylindrical wall of the piston chamber 10 all around the same.

A second set of passageways from the central chamber to the explosion chamber is through the piston themselves. As shown in FIGS. 7 to 10A, the top wall of each piston is formed with two orifices 120 each closed by a check valve 122 which allows passage of the combustible gases only in one direction, namely from the central chamber to the explosion chamber formed by the cylinder head 12 and the adjacent part of the piston chamber over the piston. Each check valve 122 may be in the form of a leaf spring fixed to the top of the piston by bolts 124. The leaf springs act under a pressure differential to open the orifices 120 when the pressure within the piston is higher than in the explosion chamber.

Obviously other types of check valves responsive to the pressure differential could be used, if necessary, to properly resist the pressure produced in the piston chamber during combustion.

FIG. 8 further shows the conventional piston rings 126, wrist pin 128 connecting the piston to the connecting rod and the arrangement of the connecting bolt 102 pivotally connecting the connecting rod to the crank assembly formed by wheel 96 and disk 100.

Referring again to FIG. 2, it is seen that each cylinder head 12 forms an exhaust passage 130, downstream from the exhaust valve 32, which communicates with an exhaust nozzle 132 fully opened at its outer end and fixed to the cylinder head at right angles so the long axis of the piston chamber and extending away from the direction of rotation of the engine block as indicated by the arrows 108.

The engine is air-cooled, the cylinder heads being provided with cooling fins 134 and each piston chamber being provided with cooling fins 136.

Figure 4:
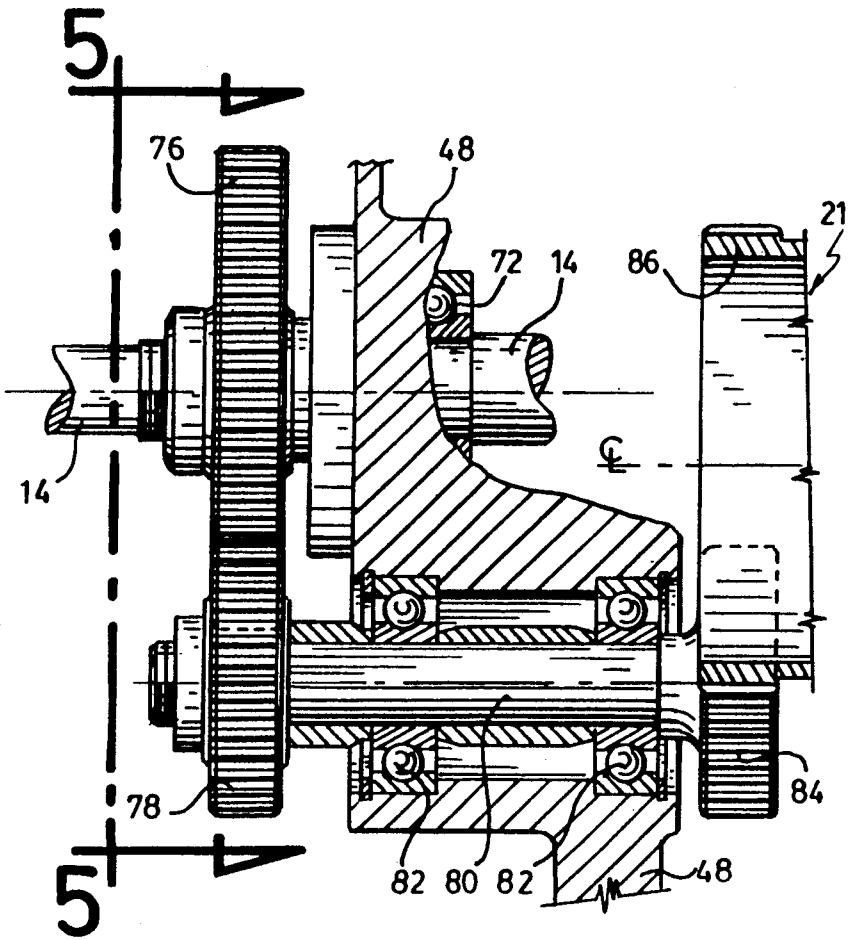
FIG. 4 is an enlarged section taken in area 4 of FIG. 3.
Figure 5:
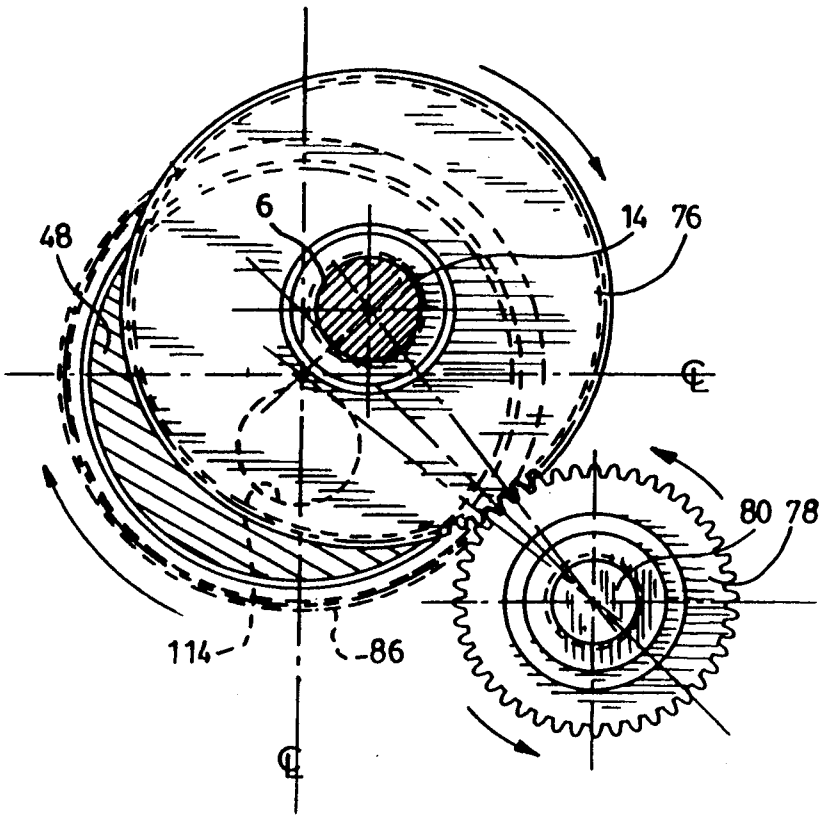
FIG. 5 is a cross-section taken along line 5—5 of FIG. 4.

Referring again to FIGS. 4 and 5 which are directed to the drive train, it is seen that the auxiliary shaft 80 is so positioned with respect to the engine block rotation axis 6 and to the crank shaft 14 that its sprockets 78 and 84 will mesh with main gear 76 and annular gear 86 at the point of intersection of these two last named gears when seen in end view.

FIG. 13 shows a schematic diagram of the fuel circuit including the conventional fuel reservoir 137 containing proper mixture of gasoline and lubricating oil, the engine described being a two stroke engine. The fuel mixture is directed to a conventional carburator 138 and the air and fuel mixture is preferably pressurized by a pump or blower 140 serving as a supercharger to feed the mixture under pressure within the central chamber 8 through the lateral feeding tube 112 and bore 114.

FIG. 14 is a schematic diagram of the electrical system showing the conventional parts as follows: battery 142 with its ground connection 144 and positive wire 146, recharged by generator 143 and voltage regulator 145, and feeding the engine starter motor 28, the amperemeter 148, the lighting system 150, if necessary, and also feeding through the ignition switch 152 and current regulator 154 the induction coil 156 which supplies high voltage through a distributor box 158 to the conducting emitter strip 160 of insulated rig section **66*a*, which stays in electrically conducting relation with the collector pin 58 of any one spark plug 56** for a few degrees of rotation of the engine block when the related piston is in outer dead position.

Figures 6, 6A, 6B, 6C, 6D, 6E:
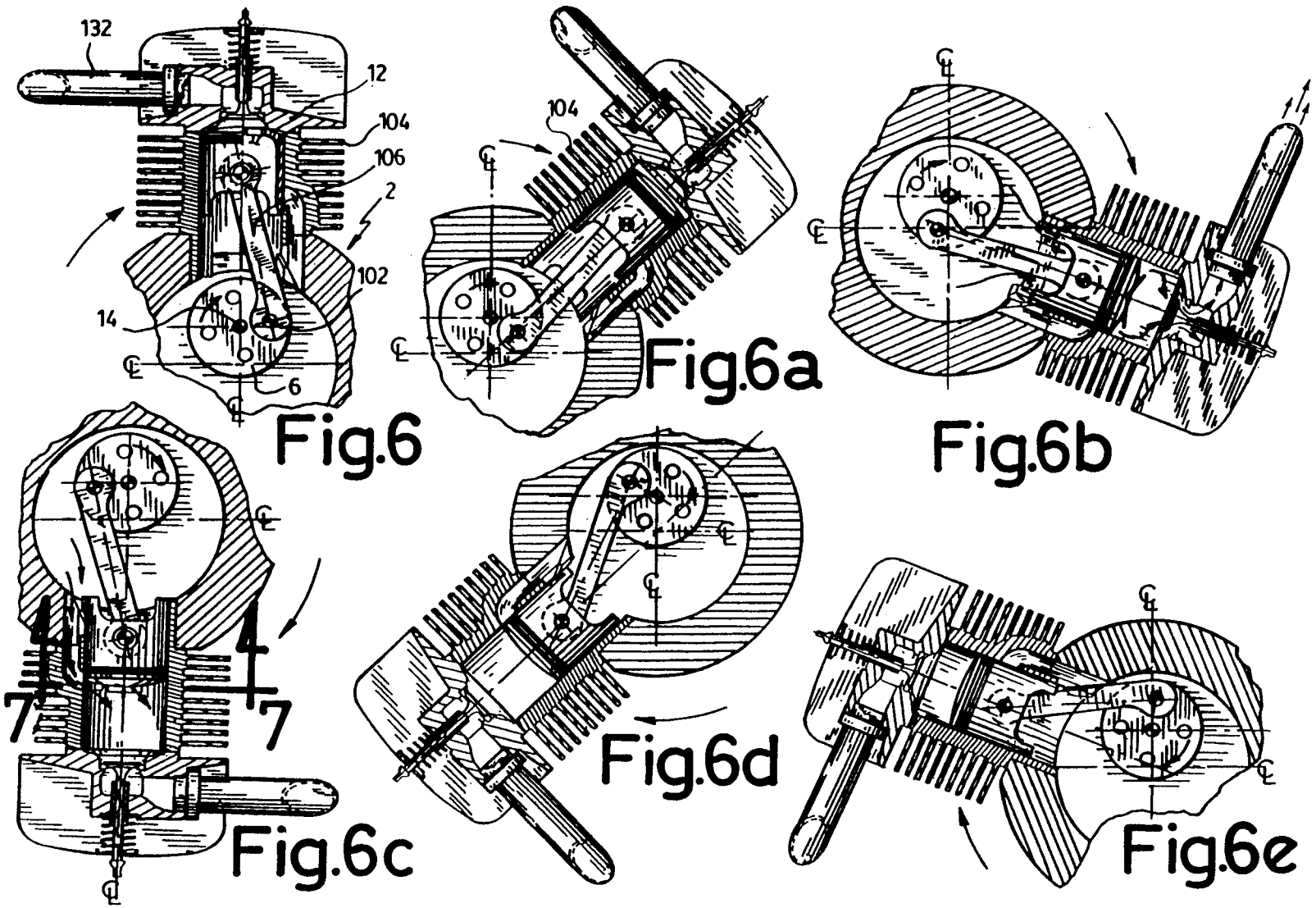

The engine operates as follows: the engine is a two-stroke engine, namely any given piston will effect two strokes for each engine explosion, a radially outward stroke and a radially inward stroke. Referring to FIGS. 6, 6A to 6E, the engine block 2 is shown in successive angular positions with the piston in any one given piston chamber taking a corresponding longitudinal position within the piston chamber due to the offset of the cam shaft 14 with respect to the rotational axis 6 of the engine block. In FIG. 6, the piston is in outward dead position, the exhaust valve is closed and also the intake ports, the leaf spring check valves 122 being also closed, the combustible gas being fully compressed over the piston; firing takes place and then combustion of the gases, the working stroke takes place during rotation of the engine block through approximately more than one quarter revolution at which point, as shown in FIG. 6B, the exhaust valve 32 opens under the action of the cam 44 (see FIG. 12), exhaust gases escape through exhaust nozzle 132 and they act as a jet to assist the engine block rotation. When the explosion has decreased below the pressure existing in the central chamber 8 as produced by the blower 140, the leaf spring check valves 122 open and the fresh combustible gases serve to sweep away the exhaust gases. The sweeping efficiency is increased due to the centrifugal force exerted on the gases because of the engine block rotation.

The exhaust valve closes, and the piston, valves 122 remaining open, continues its radially inward stroke; the intake ports 118 are uncovered as shown in FIG. 6C, and additional fresh combustible gases enter the explosion chamber. These gases are compressed during the compression stroke of the piston, the latter first closing the ports 118 and fully compressing the gases to be fired as shown in FIG. 6.

It should be noted that a maximum torque is developed on the crank shaft during all of the combustion stroke, and that a full piston stroke is equal to substantially the sum of the offset distance between the engine block rotation axis 6 and the axis of the crank shaft 14 and of the distance between the connection point 102 and the axis of the crank shaft 14.

Actual experimentation of a prototype built in accordance with the present invention has shown that the idle speed of such a prototype is about half the idle speed of a conventional piston engine. This is most probably due to above-noted characteristics. The engine, when adequately dynamically balanced, produces less vibration than in a conventional engine. Cooling efficiency is obtained even if the engine is air cooled due to engine block rotation and also because the fresh combustible gas flows through the piston itself.

The intake valves within the piston also greatly helped in the breathing efficiency of the engine together with the centrifugal force which is produced both on the combustible admission gases and the exhaust gases because of engine block rotation.

Low idle speed results in economical overall operation and less engine wear.

A diesel engine is also theoretically possible using the basic principle of the invention.

Although the output torque is obtained through power output shaft 16 in the embodiment shown, it is obvious that the output torque could be obtained directly from the crank shaft 14 by suitably modifying the outer end of said shaft and removing the revolution counter at this outer end; this would avoid transmitting torque through the drive train formed by the gears 76, 78, auxiliary shaft 80, sprocket 84 and annular gear 86. In this case, this drive train would only serve to rotate the engine block synchronously with the crank shaft.

Although a four-cylinder engine has been shown, it is obvious that the number of cylinders may be increased or decreased.

In FIG. 15 two engines, in accordance with the invention, are arranged face to face, the engine blocks 2 mounted on a common support 4*a* and with the respective output shafts 16 co-axial and interconnected by a sprocket 162 which drives through a drive chain 164, a sprocket 166 of a common output shaft 168 mounted for rotation on the support 4. The angular orientation of the offset between the power shaft and the crank shaft of the respective engines are different so as for instance provide firing at 45 degrees apart from one engine to the other as denoted by the angular shifting of the respective ignition current emitter assemblies 170 which include a ring section 66*a*.

In the present engine, referring to the schematic of FIG. 13, it might be desirable, in accordance with the timing of the opening and closing of the various admission ports and exhaust valves, that a check valve be provided in the admission circuit between the blower 140 and the admission tube 112 of the engine block. This check valve would prevent return of the admission gases towards the blower.

The fact that all the connecting rods are in the same plane results in an engine which is short in length.

The ignition system which provides for firing of the spark plugs through several degrees of engine block rotation results in a fool-proof starting of the engine. Also, there is no need to provide a system for advancing or retarding the firing with respect to the outer dead position of the piston.

The twin engine arrangement of FIG. 15 provides for an explosion for each 45 degrees of engine block rotation, the fuel system and ignition systems can be common to both engines though independent adjustments of the position of blocks 66*a* might be required.

At idle speed, engine cooling is still very efficient even if the vehicle in which the engine would be installed is stopped.

I claim:

1. A rotary internal combustion engine comprising a support and an engine block mounted on said support for rotation about an engine block rotation axis, said engine block defining a central chamber and at least one radial piston chamber outwardly protruding from said central chamber and communicating therewith at its radially inner end, a piston chamber head closing the radially outer end of said piston chamber and defining an explosion chamber with said piston chamber, a crank shaft rotatably mounted in said engine block, parallel to and radially offset from the engine block rotation axis, a drive train drivingly coupling said engine block and said crank shaft, said crankshaft and said engine block rotating in the same direction and at the same speed, a piston reciprocable within said piston chamber, a connecting rod pivotally connected to said piston and to a connecting point of said crank shaft which is radially spaced from the rotation axis of said crank shaft and angularly advanced in the direction of rotation of said engine block relative to the longitudinal axis of said piston chamber.

2. An engine as defined in claim 1, wherein said crank shaft is a power output shaft.

3. An engine as defined in claim 1, further including a power output shaft fixed to said engine block on one side of said central chamber, co-axial with said engine block rotation axis and journaled in said support.

4. An engine as defined in claim 3, wherein said crank shaft forms a second power output shaft.

5. An engine as defined in claim 1, further including combustible gas intake means communicating with said central chamber and a first passage means communicating said central chamber with said explosion chamber.

6. An engine as defined in claim 5, wherein said first passage means extends through said piston and further including check valve means carried by said piston to permit passage of said combustible gas only from said central chamber to said explosion chambers.

7. An engine as defined in claim 5, further including ignition means carried by said cylinder head.

8. An engine as defined in claim 7, further including exhaust gas valve means carried by said cylinder head.

9. An engine as defined in claim 8, further including an exhaust gas discharge nozzle fixed to said cylinder head, substantially normal to the longitudinal axis of said piston chamber and extending away from the direction of rotation of said engine block.

10. An engine as defined in claim 5, wherein said first passage means extends through said engine block and exteriorly of said piston chamber.

11. An engine as defined in claim 6, further including second passage means extending through said engine block and exteriorly of said piston chamber and communicating said central chamber with said explosion chamber.

12. An engine as defined in claim 6, wherein said check valve means are actuated by a pressure differential across said piston.

13. An engine as defined in claim 12, further including combustible gas pumping means in said intake means.

14. An engine as defined in claim 11, which is a two-stroke engine and further including additional radial piston chambers equally angularly spaced from one another and from said first named piston chamber, a piston and a connecting rod in each piston chamber, the connecting rods connected to connecting points of said crank shaft which are equally radially spaced from the rotation axis of said crank shaft and are equally angularly spaced from one another.

15. An engine as defined in claim 14, further including fin means protruding from said engine block around said piston chambers.

16. An engine as defined in claim 14, further including ignition means for each explosion chamber and including an emitter fixed to said support and extending in the direction of engine block rotation, means to supply a continuous high voltage current to said emitter, an ignition plug carried by each cylinder head and exposed in said explosion chamber and a collector electrically connected to each plug and fixed to said cylinder head, one of said emitter and of said collector being elongated in the direction of engine block rotation so that both said emitter and collector remain in a mutually electrically connecting state for several degrees of engine block rotation.

17. An engine as defined in claim 16, further comprising an additional engine, each engine having a power output shaft, the two engines mounted on said support with the two output shafts extending towards each other, a sprocket gear interconnecting the two output shafts, a common output shaft rotatably mounted on said support externally of the rotational paths of said engine blocks, a second sprocket carried by said common output shaft and a drive chain meshing with the first and second sprockets, each of said engines having at least four piston chambers, the offset of the crank shaft of one engine relative to the rotational axis of the engine block of said one engine being angularly advanced with respect to the offset of the crankshaft with respect to the engine block of the other engine.

* * * * *